US008481169B2

(12) United States Patent
Kashiwagura et al.

(10) Patent No.: US 8,481,169 B2
(45) Date of Patent: Jul. 9, 2013

(54) LEATHER

(75) Inventors: Shinji Kashiwagura, Yamagata (JP); Seiji Yamaguchi, Yamagata (JP); Yoshiyuki Ito, Wako (JP); Takashi Yamaguchi, Wako (JP)

(73) Assignees: Midori Hokuyo Co., Ltd., Yamagata-shi (JP); Honda Motor Co., Ltd., Tokyo (JP)

( * ) Notice: Subject to any disclaimer, the term of this patent is extended or adjusted under 35 U.S.C. 154(b) by 263 days.

(21) Appl. No.: 12/666,806

(22) PCT Filed: Jun. 27, 2008

(86) PCT No.: PCT/JP2008/061774

§ 371 (c)(1),
(2), (4) Date: Dec. 26, 2009

(87) PCT Pub. No.: WO2009/001943

PCT Pub. Date: Dec. 31, 2008

(65) Prior Publication Data

US 2010/0325811 A1 Dec. 30, 2010

(30) Foreign Application Priority Data

Jun. 28, 2007 (JP) ..... 2007-170395

(51) Int. Cl.

| | |
|---|---|
| ***C14C 9/00*** | (2006.01) |
| ***C14C 3/16*** | (2006.01) |
| ***C14C 3/28*** | (2006.01) |

(52) U.S. Cl.

USPC ..... 428/540; 8/94.15; 8/94.19 R; 8/94.2; 8/94.21; 8/94.33; 8/94.29; 252/8.57

(58) Field of Classification Search

USPC ..... 252/8.57; 8/94.19 R, 94.2, 94.21, 8/94.22, 94.24, 94.25, 94.29, 94.33, 94.15; 428/540

See application file for complete search history.

(56) References Cited

U.S. PATENT DOCUMENTS

| | | | | |
|---|---|---|---|---|
| 2,941,859 | A | 6/1960 | Fein et al. | |
| 5,316,860 | A | 5/1994 | Stewart et al. | |
| 5,492,539 | A | 2/1996 | Bauer et al. | |
| 6,033,590 | A * | 3/2000 | Komforth et al. | 252/8.57 |
| 6,953,621 | B2 * | 10/2005 | Schaefer | 428/305.5 |
| 6,991,659 | B2 * | 1/2006 | Kittmer et al. | 8/94.24 |

FOREIGN PATENT DOCUMENTS

| | | |
|---|---|---|
| JP | S55-23193 | 2/1980 |
| JP | S55-50099 | 4/1980 |
| JP | S56-28300 | 3/1981 |
| JP | H01-292100 | 11/1989 |
| JP | H10-508644 | 5/1996 |
| JP | H08-232000 | 9/1996 |
| JP | 2000-506564 | 4/1998 |
| JP | 2001-503086 | 4/1998 |
| JP | H10-101757 | 4/1998 |
| JP | H10-195500 | 7/1998 |
| JP | 2001-513129 | 9/1998 |
| JP | H11-158500 | 6/1999 |
| JP | 2000-119700 | 4/2000 |
| JP | 2001-187882 | 7/2001 |
| JP | 2001-247900 | 9/2001 |
| JP | 2001-513831 | 9/2001 |
| JP | 2004-149797 | 5/2004 |
| JP | 2005-272725 | 6/2005 |
| WO | 88/03958 | 6/1988 |
| WO | WO96/15276 | 5/1996 |
| WO | WO98/14620 | 4/1998 |
| WO | WO98/16662 | 4/1998 |
| WO | WO98/38340 | 9/1998 |
| WO | WO98/38341 | 9/1998 |

OTHER PUBLICATIONS

Shinpan Hikaku Kagaku (New Leather Science), Nov. 25, 1992, Japanese Association of Leather Technology, pp. 46-62.

* cited by examiner

*Primary Examiner* — Lorna M Douyon
*Assistant Examiner* — Amina Khan
(74) *Attorney, Agent, or Firm* — Hamre, Schumann, Mueller & Larson, P.C.

(57) ABSTRACT

A leather obtained by a (1) pre-treatment before tanning, (2) tanning process where glutaraldehyde is used as a tanning agent, (3) process where a re-tanning agent is used which is constituted by synthetic tannin, resin and aluminum, of which the synthetic tannin is constituted by (a) condensation product of aromatic sulfonic acid with formaldehyde or mixture of aromatic sulfonic acid and condensation product of aromatic sulfonic acid with formaldehyde, (b) methylene cyclic polymer of aromatic sulfonic acid with hydroxy aromatic compound or mixture of aromatic sulfonic acid and methylene cyclic polymer of aromatic sulfonic acid with hydroxy aromatic compound and (c) glyoxal, while the resin is constituted by (a) acrylic acid, methacrylic acid, acrylic acid ester or methacrylic acid ester polymer(s) and mixture thereof, and copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning; wherein said leather is characterized in that it is flexible and has unique elasticity and softness beyond what is presented by the material hide and has restorability that prevents the leather from stretching more than it should, and also in that its conditions include a BLC stiffness/softness of 4.42 mm or more but 4.90 mm or less and maximum set ratio of 10.7 or more but 13.9 or less.

4 Claims, 4 Drawing Sheets

LEATHER

This application is the U.S. National Phase under 35 U.S.C. §371 of International Application PCT/JP2008/061774, filed Jun. 27, 2008, which claims priority to Japanese Patent Application No. 2007-170395, filed Jun. 28, 2007. The International Application was published under PCT Article 21(2) in a language other than English.

TECHNICAL FIELD

The present invention relates to leather obtained through a pre-treatment before tanning, tanning process using glutaraldehyde as a tanning agent, re-tanning process including re-tanning, and post-treatment after re-tanning.

PRIOR ART

Any process where leather for human use is manufactured from raw animal hide consists of a combination of a series of different processes. A process of manufacturing leather from raw animal hide comprises: (1) pre-treatment before tanning (where unnecessary tissues and constituents attached to the raw animal hide are separated and removed to produce material hide), (2) tanning process (where the material hide is treated with a tanning agent to add heat resistance, corrosion resistance and flexibility to produce leather), (3) re-tanning process (where the leather is treated with a re-tanning agent and then dyed and fatliquored to add favorable touch, gloss and water resistance), and (4) post-treatment after re-tanning and finishing process (where the re-tanned leather is dried and coated).

All these processes can be performed successively, but there have been efforts, in order to obtain the leather as a finished product, to divide these processes by, for example, performing the pre-treatment before tanning at one location and performing the remaining processes at another location, or by performing the processes through tanning at one location and performing the remaining processes at another location.

To enhance the quality of obtained leather, it is especially important to perform the aforementioned (2) tanning process, (3) re-tanning process and (4) post-treatment after re-tanning and finishing process sufficiently, while combining these processes in an organic manner. Among others, selection of tanning agent and re-tanning agent is an important factor that determines the quality of obtained leather. The tanning agent is caused to permeate through the structure of material hide and thereby introduce cross-linking bond among collagen molecules to an appropriate extent. If cross-linking is insufficient, the heat resistance of leather does not improve. If cross-linking is excessive, on the other hand, the movement of fibers in leather is limited and the leather becomes hard and easy to break although its heat resistance improves.

In addition to providing the aforementioned tanning action, the re-tanning agent must also be able to increase fine gaps to enhance the volume of leather and add warm touch to it. Following the treatment with the re-tanning agent, a fatliquoring agent acts upon the fine gaps obtained by the tanning agent and causes water in leather fibers to be replaced with an oil agent. As a result, the texture will not become rigid or hard after drying and the lubrication among fibers will increase, resulting in added flexibility of leather. In recent years, a technology is reported for optimizing the color, levelness, flexibility, solidity and behavior upon water exposure (hydrophobicity) of leather and fixing the tanning agent (Patent Literature 20), among others.

The tanning agent and re-tanning agent have different actions and roles, and traditionally different substances have been combined as the tanning agent and re-tanning agent instead of using the same substance for both the tanning agent and re-tanning agent. Although their number is not large, there have been proposals to use the same substance as the tanning agent and re-tanning agent in certain cases like those explained later. This is probably due to the specific characteristics to be added to leather through tanning and re-tanning, but whatever the reason, there might be a problem associated with identifying appropriate agents to be used for each.

In the treatment of leather, it is technically important to determine which fatliquoring agent to use in addition to the tanning agent and re-tanning agent.

As a result of compilation of many years of experience, tanning agents have largely been consolidated into chromic tanning agents using a trivalent Cr complex. Chromic tanning agents are said to provide many benefits such as higher heat resistance with a shrinkage temperature difference of as high as 120° C., higher resistance to decay and chemicals, little change in fiber structure of tanned material hide, ability to remove chromium using organic acids, flexibility, elasticity, and good dyeing property, among others.

However, chromic tanning agents present concerns in that they may cause environmental pollution and labor health problems, and therefore society is demanding adoption of non-chromic tanning agents to replace chromic tanning agents as well as development of new tanning methods therefor.

In applications where non-chromic tanning agents are used, there have been efforts to reconsider using traditionally known tanning agents and to establish tanning and re-tanning processes in pursuit of new effective properties of leather obtained by using tanning and re-tanning agents in combination.

Traditionally known tanning agents include iron, aluminum (Patent Literature 15), zirconium and other metal salts, plant-based tannin, aromatic sulfonic acid, condensation product of aromatic sulfonic acid with formaldehyde and other synthetic tanning agents (Patent Literatures 4, 7, 10, 11 and 13), condensation products of urea, melamine and other nitrogen-containing base compounds with aldehyde (Patent Literature 6), resin tanning agents using acrylic resin (Patent Literatures 13, 14 and 15) and other resins, and dialdehydes.

Among non-chromic tanning agents, glutaraldehyde is considered promising (Patent Literatures 1, 2, 3, 11, 13 and 15).

When using non-chromic tanning agents whose effectiveness is not as good as chromic tanning agents, an ingenuous idea must be applied in the form of combining a non-chromic re-tanning agent with other non-chromic re-tanning agent, to achieve effectiveness equivalent to chromic tanning agents.

Re-tanning agents that can be used after tanning using a chromic tanning agent, etc., include, among others, chrome, aluminum, zirconium and other inorganic tannins, plant-based tannin, aromatic sulfonic acid, condensation product of aromatic sulfonic acid with formaldehyde and other synthetic tannins, condensation products of amino compounds with formaldehyde, condensation products of urea, melamine and other nitrogen-containing base compounds with formaldehyde, acrylic resin and other resin tannins, and glutaraldehyde (Non-patent Literature 1).

Among the above, use of synthetic tannins such as aromatic sulfonic acid and condensation product of aromatic sulfonic acid with formaldehyde (Patent Literatures 4, 5, 6, 7, 8, 9 and 10) has been considered promising.

A method of combining aliphatic dialdehyde or anion aromatic synthetic tannin (such as any sulfonated aromatic compound) has been known for use as a re-tanning agent after the tanning performed with a non-chromic tanning agent such as dialdehyde (Patent Literature 11). The aforementioned application results in good whiteness and provides leather having a high heat shrinkage temperature.

Combining a re-tanning treatment using a tanning agent containing aromatic-sulfonic-acid synthetic tannin, with a fatliquoring treatment using a fatliquoring agent containing sulfated oil, sulfonated oil and sulfited oil, provides favorable results (Patent Literature 9)

It is also known that combining a re-tanning agent constituted by aromatic sulfonate, formaldehyde or other aldehyde resin and chrome or other aluminum compound increases flexibility and is useful for anionic coloring (Patent Literature 7). Aldehyde resins that are used for the aforementioned purpose include urea-formaldehyde condensation product, melamine-formaldehyde condensation product and/or melamine-urea-formaldehyde condensation product.

Including a re-tanning treatment process using 1 to 2% powder mimosa tannin, Basyntan (by BASF) being a powder polycondensation product of phenol sulfonic acid with formaldehyde, or mixture of paraffin and anion surface active agent (Patent Literature 8) improves the water-proofing property and water repellency of leather.

Treatment agents constituted by sulfonated aromatic compounds, aldehyde and/or ketone and phenol, cresol and dihydroxy diphenyl methane, and urea and urea derivatives, are known (Patent Literature 10). These treatment agents have the effect of providing leather with improved density and depth.

A treatment using a homo copolymer of dialdehyde and acrylic acid or methacrylic acid, and acrylate copolymer or other polymer compound, is also known (Patent Literature 13). Although the said invention uses tannin as a re-tanning agent, use of plant-based tannin or synthetic tannin is expressly denied.

A treatment intended to form micelle, when water is added, by combining a re-tanning agent constituted by condensation product of sulfonated phenol or cresol with formaldehyde, condensation product of naphthalene sulfonic acid with formaldehyde or acrylate copolymer or fatliquoring agent is also known (Patent Literature 12). This treatment is considered favorable in terms of flexibility and dyeing property.

In addition, Patent Literature 14 uses polyacrylic acid, etc., to prevent dusting, while a treatment is also known that uses a mixture containing tannin and/or acrylic resin base as well as silica in colloidal suspension state (Patent Literature 15). The said invention uses a combination of organic tannin and acrylic resin.

Furthermore, a fully biodegradable leather is known, among others, which is obtained by (I) pre-tanning using a tanning agent containing aldehyde or carbamoyl sulfonic acid group, (II) re-tanning using polyaspartic acid and/or polyaspartic acid amide, (III) pre-dyeing using polyurethane and natural auxiliaries and finishing using polyurethane and/or polyester amide, and, if necessary, (IV) post-treatment using a leather preserving product (Patent Literature 16).

Another tanning method is known whereby pre-tanning is performed by soaking material hide in a mixture solution of glutaraldehyde, alkylated complex activator having affinity with fibers of material hide and vegetable oil or fish oil or mineral oil, followed by soaking in a mixture solution of tannin, alkylated complex activator having affinity with fibers of material hide and vegetable oil or fish oil or mineral oil having tanning property (Patent Literature 17).

There is also an invention pertaining to re-tanning using cod oil, wherein tanning is performed using glutaraldehyde, while cod oil is put in a drum as tanning oil and the drum is rotated while raising the temperature to perform oil tanning (Patent Literature 18). This invention provides formalin-free leather.

The above described compounds relating to tanning and re-tanning that achieve more favorable flexibility and dyeing property compared to conventional tanning and re-tanning Specific operations include combining specified treatment agents for tanning and re-tanning, or even combining synthetic tanning agent with resin in the case of a synthetic tanning agent. They do not involve any tanning or re-tanning process performed for the purpose of achieving what is intended, during re-tanning, by the inventors of the present invention as explained below.

In addition to the need for converting their manufacturing process to one using non-chromic tanning agents, leathers obtained through a treatment using a non-chromic tanning or re-tanning agent is now required to have characteristics equivalent to or better than those of leathers obtained through a treatment using a conventional chromic tanning or re-tanning agent.

From the standpoint of users of leather products in the automobile industry, etc., what is needed is leather having different characteristics compared to the traditional ones and more advanced characteristics instead of pursuing the leather which is simply good to touch, flexible or feels luxurious. To be specific, leathers traditionally used for automobile seats are designed to stretch in an assumed use environment or specifically a favorable environment where the leather does not receive any unnecessary load. When the leather is assumed to be subject to a substantial load, however, it is not desirable for the leather to stretch further, and ultimately excessively, due to such load, if and when applied. It is not desirable for a heavy person, when seated, to sink completely into the seat. The seat must have an appropriate level of restorability to secure the person's entire body in the seat by firmly supporting the lower back of the body when the person sits down on the seat and position his or her body in the seat in an appropriate position. In addition, the seat must have such characteristics that once the person leaves the seat, it will return to its original shape. If the seat does not fully return to its original shape, the seating surface will remain concaved and thus look ugly, or the bolsters of the seat (raised areas on both sides of the seating surface) will form lines easily due to rubbing with the body of each person who enters/exits the vehicle. Furthermore, coating film must not peel from these lines.

Solutions have been reported to answer the above requirements which involve reinforcing leather through resin treatment to reduce stretching of leather, or laminating resin on top of leather to prevent stretching of leather, because solving these problems by improving the characteristics of leather through tanning is deemed difficult. If these countermeasures are taken, however, misalignment occurs between the leather and the resin to be bonded through resin treatment or other leather to be laminated on top, due to different characteristics, in which case satisfactory results cannot be obtained. There is an invention that aims to manufacture a flexible leather laminate consisting of flexible fabric and flexible leather, by causing the direction of high flexibility of the aforementioned fabric to virtually align with the direction of high flexibility of the aforementioned leather in the pre-defined area of the aforementioned leather (Patent Literature 19). However, this requires cumbersome operations.

The inventors of the present invention considered that, to solve the aforementioned problems by avoiding the undesirable effects explained above, it would be necessary to improve the characteristics of leather themselves and such improved characteristics not available in the state of material hide must be achieved through tanning and re-tanning.

The inventors of the present invention understood that to provide a new leather for luxurious automobile seats, a leather manufacturing method must be completed for providing a leather which has unique elasticity and softness beyond what is presented by the material hide, has restorability that prevents stretching beyond the point of no longer returning to the original shape, does not deteriorate over time, and presents the luxury feel often associated with leather. Such leather has unique elasticity and softness beyond what is presented by the material hide, as well as restorability that prevents the leather from stretching more than it should. Research began with the aim of obtaining such leather.

Patent Literature 1: U.S. Pat. No. 2,941,859

Patent Literature 2: Japanese Patent Laid-open No. Hei 1-292100

Patent Literature 3: Japanese Patent Laid-open No. 2005-272725

Patent Literature 4: Japanese Patent Laid-open No. Sho 56-28300

Patent Literature 5: Japanese Patent Laid-open No. 55-23193

Patent Literature 6: Japanese Patent Laid-open No. 55-50099

Patent Literature 7: Japanese Translation of PCT Patent Application No. 2001-513831

Patent Literature 8: Japanese Patent Laid-open No. 2000-119700

Patent Literature 9: Japanese Patent Laid-open No. Hei 11-158500

Patent Literature 10: Japanese Patent Laid-open No. Hei 10-101757

Patent Literature 11: Japanese Patent Laid-open No. Hei 8-232000

Patent Literature 12: Japanese Patent Laid-open No. Hei 10-195500

Patent Literature 13: Japanese Translation of PCT Patent Application No. 10-508644

Patent Literature 14: Japanese Patent Laid-open No. 2001-187882

Patent Literature 15: Japanese Translation of PCT Patent Application No. 2001-503086 (Pat. No. 3,834,064)

Patent Literature 16: Japanese Translation of PCT Patent Application No. 2001-513129

Patent Literature 17: Japanese Patent Laid-open No. 2001-247900

Patent Literature 18: Japanese Patent Laid-open No. 2005-272725

Patent Literature 19: Japanese Translation of PCT Patent Application No. 2000-506564

Patent Literature 20: Japanese Patent Laid-open No. 2004-149797

Non-Patent Literature 1: Shinpan Hikaku Kagaku (New Leather Science), Nov. 25, 1992, Japanese Association of Leather Technology, pp. 46-62

SUMMARY OF THE INVENTION

Problems to be Solved by the Invention

The present invention aims to achieve chrome-free tanning using glutaraldehyde as a tanning agent, perform re-tanning, followed by dyeing and fatliquoring treatment, to obtain a leather having greater flexibility than other leathers obtained by tanning using a conventional chromic tanning agent or traditionally known glutaraldehyde and by re-tanning using a re-tanning agent, followed by dyeing and fatliquoring treatment, while at the same time providing the leather having characteristics such as unique elasticity and softness beyond what is provided by the material hide, as well as restorability that prevents the leather from stretching more than it should but causes it to return to its original condition after use.

Means for Solving the Problems

[1] In solving the problems mentioned above, the inventors considered that, since the purpose is to obtain leather characteristics not heretofore available, these characteristics of the obtained leather must be quantitatively measured and the measured results must be used to evaluate the leather. Accordingly, the following items were measured to determine the degree of achievement of such characteristics.

To evaluate if the "leather has unique elasticity and softness beyond what is provided by the material hide, has restorability that does not cause the leather to stretch beyond the point of no longer returning to its original shape, and presents the luxury feel often associated with leather," "BLC stiffness/softness" and "maximum set ratio" were set as new evaluation standards and their measured values were used to make judgment.

[2] The evaluation methods for the above items are explained below.

(1) "BLC stiffness/softness" is measured as the depth by which a leather test piece sinks when pressed by a load of 500 g per unit area. It is a measure of flexibility and resilience and expressed in mm. The BLC stiffness/softness reading provides an indicator of flexibility.

(2) "Maximum set ratio" is measured by collecting separate test pieces from leather in the two orthogonal directions of X-axis and Y-axis. Of the measured set ratios, the greater value is taken as the maximum set ratio. The set ratio is expressed by the percentage of the elongation when the sample is stretched under a load of 8 kg, relative to the standard elongation measured after the load is removed and sample returns to its original shape, and is intended as a measure of restorability.

The above two values were measured to make judgment on the condition of leather, and the leather was deemed favorable when both results fell within satisfactory ranges.

[3] Next, various combinations of re-tanning and fatliquoring agents were examined to solve the aforementioned problems, and the conditions of obtained leathers were judged based on the aforementioned "BLC stiffness/softness" and "maximum set ratio.

[4] All processes through which the aforementioned problems could be solved are explained below:

A "A leather characterized in that it is obtained by a (1) pre-treatment before tanning, (2) tanning process where glutaraldehyde is used as a tanning agent, (3) process where a re-tanning agent is used which is constituted by synthetic tannin and resin, of which the synthetic tannin is constituted by (a) condensation product of aromatic sulfonic acid with formaldehyde or mixture of aromatic sulfonic acid and condensation product of aromatic sulfonic acid with formaldehyde, (b) methylene cyclic polymer of aromatic sulfonic acid with hydroxy aromatic compound or mixture of aromatic sulfonic acid and methylene cyclic polymer of aromatic sulfonic acid with hydroxy aromatic compound and (c) glyoxal, while the resin is constituted by (a) acrylic acid, methacrylic acid, acrylic acid ester or methacrylic acid ester polymer(s) or mixture thereof, or copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning."

B "A leather characterized in that it is obtained by a (1) pre-treatment before tanning, (2) tanning process where glutaraldehyde is used as a tanning agent, (3) process where a re-tanning agent is used which is constituted by synthetic tannin, resin and aluminum compound, of which the synthetic tannin is constituted by (a) condensation product of aromatic sulfonic acid with formaldehyde or mixture of aromatic sulfonic acid and condensation product of aromatic sulfonic acid with formaldehyde, (b) methylene cyclic polymer of aromatic sulfonic acid with hydroxy aromatic compound or mixture of aromatic sulfonic acid and methylene cyclic polymer of aromatic sulfonic acid with hydroxy aromatic compound and (c) glyoxal, while the resin is constituted by (a) acrylic acid, methacrylic acid, acrylic acid ester or methacrylic acid ester polymer(s) or mixture thereof, and copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning."

C "A leather according to A, characterized in that per 100 percent by weight of shaved leather, the aforementioned re-tanning agent is constituted by 20 to 30 percent by weight of synthetic tannin and 13 to 25 percent by weight of resin (both relative to 100 percent by weight of shaved leather), while the aforementioned synthetic tannin is constituted by (a) 0.45 to 0.50 of condensation product of aromatic sulfonic acid with formaldehyde or mixture of aromatic sulfonic acid and condensation product of aromatic sulfonic acid with formaldehyde, (b) 0.38 to 0.43 of methylene cyclic polymer of aromatic sulfonic acid with hydroxy aromatic compound or mixture of aromatic sulfonic acid and methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, methacrylic acid, acrylic acid ester or methacrylic acid ester polymer(s) or mixture thereof, and copolymer(s) thereof or mixture thereof and (b) 0.28 to 0.33 of polycondensation product of melamine with formaldehyde (all are weight ratios, the total of which is 1.00), wherein the fatliquoring agent constituted by (a) synthetic oil and natural oil and (b) mixture of synthetic oil and natural constituent is used by 15 to 19 percent by weight relative to 100 percent by weight of shaved leather."

D "A leather according to A or C, characterized in that a sample taken from a part of the leather obtained by re-tanning and subsequent post-treatment meets conditions including a BLC stiffness/softness of 4.42 mm or more but 4.90 mm or less and maximum set ratio of 10.7 or more but 13.9 or less."

E "A leather according to B, characterized in that the aforementioned re-tanning agent is constituted by 20 to 30 percent by weight of synthetic tannin, 13 to 25 percent by weight of resin and 0.7 to 4.0 percent by weight of aluminum, all relative to 100 percent by weight of shaved leather, while the aforementioned synthetic tannin is constituted by (a) 0.45 to 0.50 of condensation product of aromatic sulfonic acid with formaldehyde or mixture of aromatic sulfonic acid and condensation product of aromatic sulfonic acid with formaldehyde, (b) 0.38 to 0.43 of methylene cyclic polymer of aromatic sulfonic acid with hydroxy aromatic compound or mixture of aromatic sulfonic acid and methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, methacrylic acid, acrylic acid ester or methacrylic acid ester polymer(s) or mixture thereof, and copolymer(s) thereof or mixture thereof and (b) 0.28 to 0.33 of polycondensation product of melamine with formaldehyde (all are weight ratios), wherein the fatliquoring agent constituted by (a) synthetic oil and natural oil and (b) mixture of synthetic oil and natural constituent is used by 15 to 19 percent by weight relative to 100 percent by weight of shaved leather."

F "A leather according to B or E, characterized in that a sample taken from a part of the leather obtained by re-tanning and subsequent post-treatment meets conditions including a BLC stiffness/softness of 5.0 mm or more and maximum set ratio of 10% or less."

Effects of the Invention (1) The leather obtained by the present invention does not use chromium as a tanning agent and thus is chrome-free, and therefore said leather has characteristics not heretofore achievable by leathers obtained by tanning or re-tanning using a conventional chromic tanning agent or glutaraldehyde re-tanning agent, is flexible and has unique elasticity and softness beyond what is presented by the material hide, and also has restorability characteristics that prevent the leather from stretching beyond the point of no longer returning to the original shape.

(2) If a re-tanning agent constituted by synthetic tannin and resin is used, test pieces taken from a part of the obtained leather include those having favorable characteristics such as a BLC stiffness/softness of 4.42 mm or more but 4.90 mm or less and maximum set ratio of 10.7 or more but 13.9 or less. No leather having such favorable characteristics has heretofore been available.

(3) If a re-tanning agent constituted by synthetic tannin, resin and aluminum is used, test pieces taken from a part of the obtained leather include those having a BLC stiffness/softness of 5.0 mm or more and maximum set ratio of 10% or less. No leather having such favorable characteristics has heretofore been available, and such leather is more favorable than the aforementioned leather.

DESCRIPTION OF THE SYMBOLS

Figure 1:
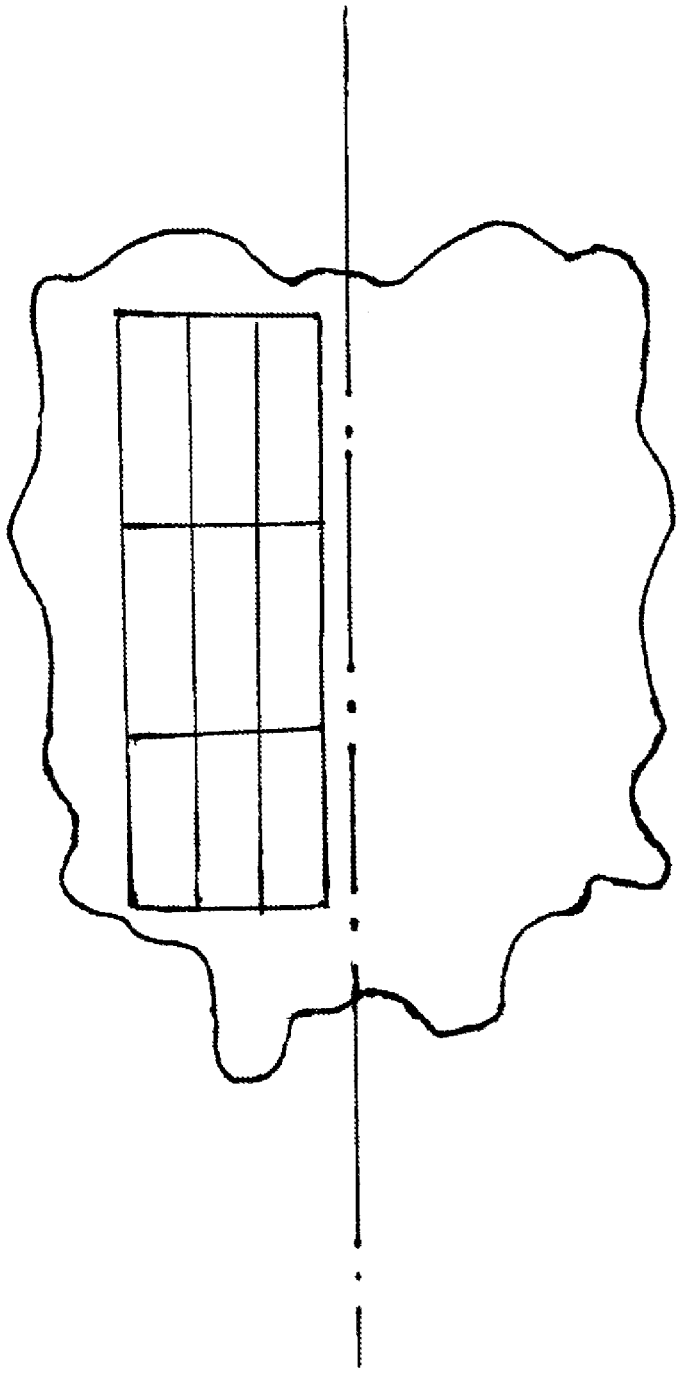
FIG. 1 Explanation of where leather samples are taken

1: Operation button
2: Top arm
3: Top leather locking device
4: Operation lever
5: Bottom leather locking device
6: Load plunger
7: Dial

BEST MODE FOR CARRYING OUT THE INVENTION

The features of each process implemented to obtain a leather conforming to the present invention are explained below.

A "A leather obtained by a (1) pre-treatment before tanning, (2) tanning process where glutaraldehyde is used as a tanning agent, (3) process where a re-tanning agent is used which is constituted by synthetic tannin and resin, of which the synthetic tannin is constituted by (a) mixture of aromatic sulfonic acid and condensation product of aromatic sulfonic acid with formaldehyde, (b) methylene cyclic polymer of aromatic sulfonic acid with hydroxy aromatic compound and (c) glyoxal, while the resin is constituted by (a) acrylic acid, methacrylic acid, acrylic acid ester and methacrylic acid ester polymer(s) or mixture thereof, and copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning."

The features of each process implemented to obtain a leather conforming to the present invention are explained below.

A "A leather obtained by a (1) pre-treatment before tanning, (2) tanning process where glutaraldehyde is used as a tanning agent, (3) process where a re-tanning agent is used which is constituted by synthetic tannin and resin, of which the synthetic tannin is constituted by (a) condensation product of aromatic sulfonic acid with formaldehyde or mixture of aromatic sulfonic acid and condensation product of aromatic sulfonic acid with formaldehyde, (b) methylene cyclic polymer of aromatic sulfonic acid with hydroxy aromatic compound or mixture of aromatic sulfonic acid and methylene cyclic polymer of aromatic sulfonic acid with hydroxy aromatic compound and (c) glyoxal, while the resin is constituted by (a) acrylic acid, methacrylic acid, acrylic acid ester or methacrylic acid ester polymer(s) or mixture thereof, and copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning."

The percentage of each constituent in A is explained below.

C "A leather according to A, characterized in that the aforementioned re-tanning agent is constituted by 20 to 30 percent by weight of synthetic tannin and 13 to 25 percent by weight of resin, both relative to 100 percent by weight of shaved leather, while the aforementioned synthetic tannin is constituted by (a) 0.45 to 0.50 of condensation product of aromatic sulfonic acid with formaldehyde or mixture of aromatic sulfonic acid and condensation product of aromatic sulfonic acid with formaldehyde, (b) 0.38 to 0.43 of methylene cyclic polymer of aromatic sulfonic acid with hydroxy aromatic compound or mixture of aromatic sulfonic acid and methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, methacrylic acid, acrylic acid ester or methacrylic acid ester polymer(s) or mixture thereof, and copolymer(s) thereof or mixture thereof and (b) 0.28 to 0.33 of polycondensation product of melamine with formaldehyde (all are weight ratios, the total of which is 1.00), wherein the fatliquoring agent constituted by (a) synthetic oil and natural oil and (b) mixture of synthetic oil and natural constituent is used by 15 to 19 percent by weight relative to 100 percent by weight of shaved leather."

All of the processes used to manufacture a leather according to A or C are explained in detail below.

(1) The pre-treatment before tanning is explained below.

Raw hide taken from adult cow hide is soaked in water and washed in water, after which the hide is taken out and mechanically cleaned of glue stock (fat and flesh) at the back, and the cleaned hide is soaked in lime solution to dissolve hair at the surface of the hide, and then dirt is removed from the surface of the hide and lime solution is permeated through the hide to loosen the fibers, after which a band knife is used to separate the hide into a silver layer (front side of the hide) and floor (back side of the hide). In this process, the above treatment is performed for the purpose of removing keratin at the surface and elastin in the bottom layer. The obtained leather is free from all constituents of hide structure other than collagen fibers. The above treatment is one that has traditionally been practiced and any treatment method already made public can be used as deemed appropriate.

(2) The "tanning" process is explained below.

The silver layer and floor obtained by the preceding process is decalcified by means of neutralizing the lime in the preceding process (by spraying pH-adjusted water and providing a treatment to make a protein decomposition enzyme to act easily; specifically, using water of 30 to 35° C. or water containing sodium hydrogensulfite that in turns contains 1 to 2% of ammonium chloride) and enzyme-decomposed in the presence of a protein decomposition enzyme (where a bating agent containing pancreatin or other enzyme is used) (through a treatment to permeate water containing the decomposition enzyme, or treatment using water that contains 0.8 to 1.2% of enzyme agent and 0.5% of ammonium chloride), after which the collagen structure is softened and enzyme is removed, followed by tanning using a tanning agent. The specific operation used here is to permeate water that contains the tanning agent.

Glutaraldehyde is used as the tanning agent. Glutaraldehyde is an aldehyde having two CHO groups (U.S. Pat. No. 2,941,859 Specification and Japanese Patent Laid-open No. Hei 8-232000). Various methods are known to manufacture glutaraldehyde. For example, it can be obtained from alkoxy dihydropyran and water in the presence of a catalyst (Japanese Patent Laid-open No. Hei 8-59535, Japanese Patent Laid-open No. 2003-508458 and Japanese Patent Laid-open No. 8-4098). Any commercially available product may be purchased and used.

Glutaraldehyde is used by 1 to 10 percent by weight relative to the weight of hide.

The treatment is given for 8 to 12 hours at 20 to 30° C. under a condition of pH1.8 to 5. Since water of approx. 30° C. is used with a tanning agent in this treatment, the heat shrinkage temperature is 65 to 70° C. when glutaraldehyde is used.

The series of treatment steps including decalcification, enzyme decomposition and tanning are performed over time in the same drum. When the tanning treatment is complete, the hide is dehydrated and strained/thinned to a desired thickness, after which the back side is shaved to adjust the thickness (this operation is called "Shaving") and unnecessary portions on the periphery of the hide are also cut off (this operation is called "Trimming").

(3) The "re-tanning" process is explained below.

The leather obtained by the tanning process is re-tanned using a re-tanning agent constituted by synthetic tannin and resin, followed by dyeing and fatliquoring with a fatliquoring agent. The re-tanning, dyeing and fatliquoring are performed for a specified period, respectively, in the same drum.

As for a re-tanning agent, the said re-tanning agent is used at the ratio of 20 to 30 percent by weight of synthetic tannin and 13 to 25 percent by weight of resin relative to 100 percent by weight of shaved leather.

Neutralization is confirmed before re-tanning is performed. A pH indicator chemical is dropped on a cut section of the leather and the layer that changes color is observed. As a rough guide, the pH value should be approx. 5 to 6 for the surface layer and approx. 3 to 4 for the inner layer in the case of upper leather.

In the re-tanning process, tanning agents, such as synthetic tanning agent, being in a water-solution state, is used preferably by 50 to 200 percent by weight relative to the weight of leather used.

The pH condition should be in a range of 3.0 to 8.0, or more preferably in a range of 3.5 to 6.5. The re-tanning treatment should preferably be performed for 1.5 to 24 hours, or especially 2 to 8 hours.

The aforementioned synthetic tannin is constituted by (a) 0.45 to 0.50 of condensation product of aromatic sulfonic acid with formaldehyde or mixture of aromatic sulfonic acid and condensation product of aromatic sulfonic acid with formaldehyde, (b) 0.38 to 0.43 of methylene cyclic polymer of aromatic sulfonic acid with hydroxy aromatic compound or mixture of aromatic sulfonic acid and methylene cyclic polymer of aromatic sulfonic acid with hydroxy aromatic compound and (c) 0.10 to 0.15 of glyoxal (all are weight ratios, the total of which is 1.00).

The aforementioned mixture of aromatic sulfonic acid and condensation product of aromatic sulfonic acid with formaldehyde (whose weight ratio is 1.0) is a mixture of more than 0 but not exceeding 0.3 (weight ratio) of aromatic sulfonic acid and less than 1 up to 0.7 (weight ratio) of condensation product of aromatic sulfonic acid with formaldehyde.

The mixture of aromatic sulfonic acid and methylene cyclic polymer of aromatic sulfonic acid with hydroxy aromatic compound (whose weight ratio is 1.0) is a mixture of more than 0 but not exceeding 0.3 (weight ratio) of aromatic sulfonic acid and less than 1 up to 0.7 (weight ratio) of methylene cyclic polymer of aromatic sulfonic acid with hydroxy aromatic compound.

The aforementioned aromatic sulfonic acid is monosulfone or disulfone or salt thereof, obtained by sulfonating an aromatic compound selected from the group that includes benzene, phenyl benzene, diphenyl ether and naphthalene, among others. Such aromatic sulfonic acid is also known for its use as a re-tanning agent (German Patent No. 578578 Specification, U.S. Pat. No. 2,315,951 Specification, U.S. Pat. No. 3,906,037 Specification, Japanese Patent Laid-open No. Sho 56-28300).

To be specific, naphthalene sulfonic acid, phenol sulfonic acid, sulfonated ditolyl ether, 4,4'-dihydroxy diphenyl sulfone, sulfonated diphenyl methane or sulfonated biphenyl, sulfonated terphenyl, or benzene sulfonic acid, naphthalene disulfonic acid, phenyl disulfonic acid, disulfonated ditolyl ether, 4,4'-dihydroxy diphenyl disulfone, disulfonated diphenyl methane, disulfonated biphenyl, disulfonated terphenyl or benzene disulfonic acid, is used.

A mixture of any of the above phenol sulfonic acids and condensation product of any of the above phenol sulfonic acids with formaldehyde can be used. To be specific, Synectan PN, Synectan WF (both by Zeneca), Tanigan LH (by Bayer), Forestane DW (by Forest), etc., can be used.

A mixture of any of the above naphthalene sulfonic acids and condensation product of any of the above naphthalene sulfonic acids with formaldehyde can be used. To be specific, Synectan ACNN (by Zeneca) can be used.

Examples include tanning agents that contain Tanigan 3LN (by Bayer), Basyntan DLX (by BASF), Forestane LC (by Forest) or other mixture of phenol sulfonic acid and condensation product of such phenol sulfonic acid with formaldehyde, or mixture of naphthalene sulfonic acid and condensation product of naphthalene sulfonic acid with formaldehyde such as PSA or NSA of Tanigan 3LN (by Bayer), Basyntan DLX (by BASF), Forestane LC (by Forest), etc.

Note that the average molecular weight of such mixture of naphthalene sulfonic acid and condensation product of naphthalene sulfonic acid with formaldehyde is 400 to 4000, while that of such mixture of phenol sulfonic acid and condensation product of phenol sulfonic acid with formaldehyde is 200 to 2000.

The methylene cyclic polymer of aromatic sulfonic acid with hydroxy aromatic compound is explained below.

The hydroxy aromatic compound is phenol, cresol or dihydroxy diphenyl methane.

The methylene cyclic polymer of aromatic sulfonic acid with hydroxy aromatic compound is a condensation product of the aforementioned hydroxy aromatic compound with formaldehyde, or condensation product of sulfonated phenol with formaldehyde, or condensation product of sulfonated phenol or cresol with formaldehyde, or condensation product of 4,4'-dihydroxy diphenyl sulfone and (hydroxy) allyl sulfonic acid with formaldehyde, condensation product of sulfone-containing aromatic hydroxy compound and allyl halogenide with formaldehyde.

Glyoxal is a compound used not only in a tanning agent under the present invention, but also in a fiber processing agent, paper processing agent, soil hardener or intermediate for organic synthesis.

General methods are known to manufacture glyoxal involve oxidization of a corresponding alcohol compound, glutaraldehyde, etc., among which a method to oxidize and dehydrogenate ethylene glycol in the presence of a silver catalyst is known (Patent Application Publication No. Sho 61-54011 and Japanese Patent Laid-open No. Hei 6-329575). Any such known substance may be purchased and used.

The aforementioned resin is constituted by (a) 0.67 to 0.72 of acrylic acid, methacrylic acid, acrylic acid ester or methacrylic acid ester polymer(s) or mixture thereof, and copolymer(s) thereof or mixture thereof and (b) 0.28 to 0.33 of polycondensation product of melamine with formaldehyde (all are weight ratios, the total of which is 1.00).

The acrylic acid, methacrylic acid, acrylic acid ester or methacrylic acid ester polymer(s) refers to a polymer obtained by polymerizing monomers selected from the group that includes acrylic acid, methacrylic acid, acrylic acid ester and methacrylic acid ester, and mixture of such polymers.

Also, the acrylic acid, methacrylic acid, acrylic acid ester or methacrylic acid ester copolymer(s) refers to a copolymer constituted by monomers selected from the group that includes acrylic acid, methacrylic acid, acrylic acid ester and methacrylic acid ester or mixture of such copolymers.

The acrylic acid, methacrylic acid, acrylic acid ester or methacrylic acid ester copolymer(s) also includes a graft polymer obtained by polymerizing monomers selected from the group that includes acrylic acid, methacrylic acid, acrylic acid ester and methacrylic acid ester, followed by further polymerization of such polymerized monomers.

A polymer should have an average molecular weight of preferably 1,000 to 250,000, or more preferably 1,000 to 100,000. Any commercially available product may be purchased and used.

The above resins are added to add visco-elasticity (rubber property) as well as hardness and property to suppress elongation. These acrylic resins are considered to have a significant contribution to improvement of the set ratio (property to easily return to the original shape after elongation) by adding elasticity to the leather. However, use of acrylic resins by the amount more than necessary is not desirable, given the characteristics of such resins, because doing so will affect the characteristics of leather excessively. Accordingly, it is important to keep the use of acrylic resins within the aforementioned ranges.

It is known through Japanese Patent Laid-open No. Sho 56-59900, Japanese Patent Laid-open No. Sho 56-161500, etc., that acrylic acids, methacrylic acids and mixtures thereof or polymers based on acrylic acid ester or methacrylic acid ester and acrylic acid and/or methacrylic acid are used as tanning agents. However, these tanning agents have been cited as having insufficient stability in some cases and therefore generating cracks on the surface (Japanese Patent Laid-open No. Hei 4-89900 and Japanese Patent Laid-open No. Hei 9-95700), and accordingly the combinations proposed by the present invention must be followed when using these tanning agents.

Polycondensation product of melamine with formaldehyde

Use of resins constituted by a polycondensation product of melamine with formaldehyde is described in Japanese Patent Laid-open No. Sho 63-89600, Japanese Patent Laid-open No. Sho 63-89599, etc.

An effective ratio of melamine and formaldehyde is approx. 1:1.5 to 1:6.

It is also effective to use a resin mixture or mixture resin constituted by a melamine formaldehyde resin formulated by melamine with formaldehyde resin and anion resin.

Furthermore, it is also effective to etherify at least a part of the melamine-formaldehyde pair using glycol ether or alkyl glycol ether and use such etherified melamine-formaldehyde pair.

Melamine resin is expected to give volume to leather, where combination of acrylic resin/melamine resin leads to the favorable results demonstrated by the present invention.

In the dyeing process, dyeing is performed using dyes.

In the dyeing process, dyes and pigments are used according to the color to dye the leather to.

The leather obtained by the aforementioned treatment method is dyed using acid water-based dyes. Acid water-based dyes are constituted by a water-based medium, dye and other constituents. The water-based medium refers to water or a mixture of water and alcohol or other water-soluble medium. As for dyes, any dyes can be used as long as they are suitable for adding color to leather, where examples include acid dyes and reactive dyes, etc.

In the fatliquoring process, leather is treated using a fatliquoring agent.

The fatliquoring process is a treatment performed after the dyeing process following re-tanning, where an oil agent called "fatliquoring agent" is used to add the flexibility required of leather products. The fatliquoring agent is formulated to easily permeate through the leather.

The leather treated in the fatliquoring process after the dyeing process is wet with water and the water present in the fiber bundles and between fibers allows the flexibility of fibers to be retained. Once this water dries up, however, fibers stick together and thus the fibers and structure become hardened. Accordingly, it is effective to treat the leather, before it dries, using an oil agent constituted by a substance that inhibits sticking of fibers. This substance also adds a function to protect leather fibers (water repellency, water-proofing property), touch, and volume. This is the purpose of the fatliquoring process using a fatliquoring agent.

The fatliquoring treatment is performed for 1 to 6 hours at a treatment temperature of approx. 25 to 50° C. The fatliquoring agent is used by 15 to 19 percent by weight relative to 100 percent by weight of shaved leather.

For the fatliquoring agent, synthetic oil and natural oil, or mixture of synthetic oil and natural oil constituent (mixed at a weight ratio of 0.4 to 0.6:0.6 to 0.4) is used. Examples of synthetic oil include sulfonated oil and specifically alkyl sulfonic acid constituted by polyolefin. Ethylene oxide oil can also be used. Examples of natural oil include sulfated oil such as ester sulfate of animal/plant-based glyceride, sulfited oil such as alkyl sulfonate of fish oil glyceride, and monoglyceride oil.

The mixing ratio for the synthetic oil and the natural oil, and the mixture of synthetic oil and natural oil constituent is determined as deemed appropriate.

(4) Among the leather processes, the post-treatment performed after re-tanning is explained below.

The re-tanned leather is post-treated via drying and finishing (drying/coating). Before drying, wet finishing is performed and then the wet, dyed/fatliquored leather is dried to realize stronger adhesion of the fatliquoring agent and dyes to achieve dye fastness, water resistance and flexibility. Then, the leather is laid flat and lines on the leather surface are ironed out. Incorporation of this ironing work is one feature of the present invention.

The moisture content after neutralization, re-tanning, dyeing and fatliquoring is approx. 70 to 80%, and this water is squeezed out and then the leather is stretched using a roll setter and dewatered to a moisture content of 50 to 60%. Thereafter, the leather is hang-dried at 25 to 50° C. to a moisture content of 10 to 5%. This drying may be performed in a glass box or in vacuum. Finally, moisture is added to the dry leather to adjust its moisture content.

Staking is performed to adjust the softness of leather. Here, vibration staking is used.

After the staking, the leather is tumbled to loosen its fibers to soften the leather. Next, the leather is dried in a net by securing it to the net by toggling.

If these operations are to be performed thoroughly, the moisture content adjustment, staking, tumbling and toggled/net drying can be repeated.

Next, the edges that were hardened by drying, scissor marks resulting from toggling, and extremely thin areas, are cut off to trim the leather shape.

Then, the leather surface is coated and colored and finishing is performed to protect the leather surface while enhancing its look at the same time.

This finishing uses semi-aniline finishing. Pigments may be used (or dyes and pigments may be combined) as coloring agents. As a binder, a protein binder (whose main ingredient is casein) or synthetic resin (emulsion or water-soluble type) may be added to cover flaws and irregularities on the silver surface to leave the silver surface pattern on the leather surface. This way, small flaws are made inconspicuous, and then colorless or dye-based coloring agents are added to form colored film. As for the coating method, rotary spray machine or roll coater is used.

The obtained leather is explained below.

Since chrome is not used as a tanning agent, the obtained leather is chrome-free, and therefore said leather has characteristics not heretofore achievable, is flexible and has unique elasticity and softness beyond what is presented by the material hide, and also has restorability characteristics that prevent the leather from stretching more than it should. When these characteristics were measured on samples taken from a part of the leather obtained by re-tanning and subsequent post-treatment, the measured conditions included a BLC stiffness/softness of 4.42 mm or more but 4.90 mm or less and maximum set ratio of 10.7 or more but 13.9 or less. These values confirm the aforementioned characteristics.

Figure 4:
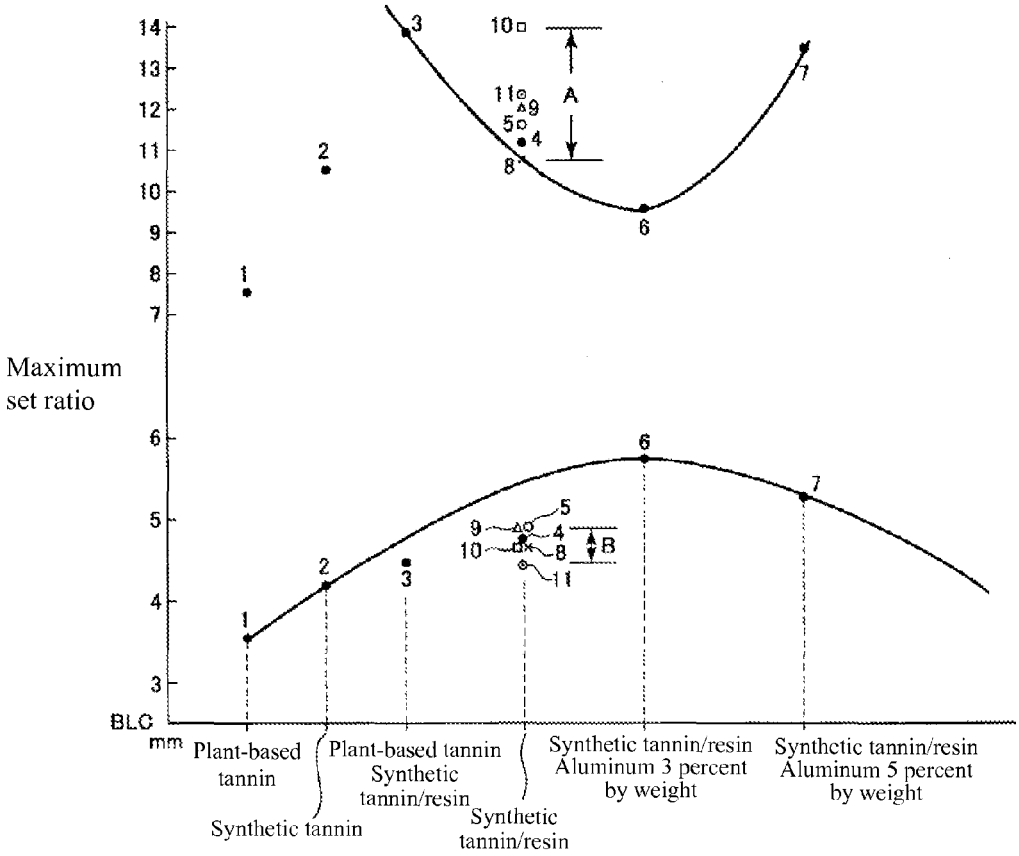
FIG. 4 Graph comparing the maximum set ratios and BLC stiffness/softness associated with Re-tanning Agents 1 to 4

These values were obtained from the results of Examples 4 and 5 (FIG. 4).

Another feature of this leather is explained below.

B "A leather obtained by a (1) pre-treatment before tanning, (2) tanning process where glutaraldehyde is used as a tanning agent, (3) process where a re-tanning agent is used which is constituted by synthetic tannin, resin and aluminum compound, of which the synthetic tannin is constituted by (a) condensation product of aromatic sulfonic acid with formaldehyde or mixture of aromatic sulfonic acid and condensation product of aromatic sulfonic acid with formaldehyde, (b) methylene cyclic polymer of aromatic sulfonic acid with hydroxy aromatic compound or mixture of aromatic sulfonic acid and methylene cyclic polymer of aromatic sulfonic acid with hydroxy aromatic compound and (c) glyoxal, while the resin is constituted by (a) acrylic acid, methacrylic acid, acrylic acid ester or methacrylic acid ester polymer(s) or mixture thereof, and copolymer(s) thereof or mixture thereof and (b) polycondensation product of melamine with formaldehyde, wherein the re-tanning agent having the aforementioned composition is used to perform re-tanning, followed by dyeing as well as fatliquoring treatment using a fatliquoring agent constituted by (a) synthetic oil and natural oil and (b) mixture of synthetic oil and natural constituent, and (4) post-treatment after re-tanning."

One feature is that the re-tanning agent also uses an aluminum compound in addition to synthetic tannin and resin. As a result, a leather having more favorable measurement results of set ratio and BLC stiffness/softness can be obtained compared to a leather according to A above, the specifics of which are described in the examples.

The percentage of each constituent in B above is explained below.

E "A leather according to B, characterized in that the aforementioned re-tanning agent is constituted by 20 to 30 percent by weight of synthetic tannin, 13 to 25 percent by weight of resin and 0.7 to 4.0 percent by weight of aluminum, all relative to 100 percent by weight of shaved leather, while the aforementioned synthetic tannin is constituted by (a) 0.45 to 0.50 of condensation product of aromatic sulfonic acid with formaldehyde or mixture of aromatic sulfonic acid and condensation product of aromatic sulfonic acid with formaldehyde, (b) 0.38 to 0.43 of methylene cyclic polymer of aromatic sulfonic acid with hydroxy aromatic compound or mixture of aromatic sulfonic acid and methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, methacrylic acid, acrylic acid ester or methacrylic acid ester polymer(s) or mixture thereof, and copolymer(s) thereof or mixture thereof and (b) 0.28 to 0.33 of polycondensation product of melamine with formaldehyde (all are weight ratios, the total of which is 1.00), wherein the fatliquoring agent constituted by (a) synthetic oil and natural oil and (b) mixture of synthetic oil and natural constituent is used by 15 to 19 percent by weight relative to 100 percent by weight of shaved leather."

Here, the re-tanning agent has, in addition to specified amounts of synthetic tannin and resin, 0.7 to 4.0 percent by weight of aluminum added in the form of an aluminum compound relative to 100 percent by weight of shaved leather.

As a result, a leather having more favorable measurement results of set ratio and BLC stiffness/softness can be obtained compared to a leather according to A above, the specifics of which are described in the examples.

Leathers according to B and D are different from those according to A and C in that (3) the re-tanning agent is constituted by synthetic tannin, resin and aluminum compound, where specifically the aforementioned re-tanning agent is constituted by 20 to 30 percent by weight of synthetic tannin, 13 to 25 percent by weight of resin and 0.7 to 4.0 percent by weight of aluminum, all relative to 100 percent by weight of shaved leather.

All other aspects are the same with the aforementioned leathers.

The details of the aforementioned synthetic tanning agent and resin are the same as mentioned above.

The aluminum compound used is explained below.

To be specific, the leather tanning agent uses aluminum sulfate solution (aluminum sulfate) and aluminum polychloride solution (Japanese Patent Laid-open No. 2006-4503). Such aluminum sulfate solution and aluminum polychloride solution can be manufactured by using aluminum hydroxide as the material and by dissolving it under heat using sulfuric acid or hydrochloric acid. Normally aluminum hydroxide is manufactured by the Bayer method, but aluminum hydroxide thus manufactured contains humate that causes scum and coloring. Accordingly, such humate is removed using cationic polymer quaternary ammonium salt (Japanese Patent Laid-open No. Sho 61-174113). As for the method to manufacture colorless aluminum sulfate solution, a sulfuric acid solution from which hydrogen peroxide has been removed can be reacted with an alumina-containing substance (Japanese Patent Laid-open No. Hei 5-229818), or a sulfuric acid solution containing hydrogen peroxide can be reacted with an alumina hydrate containing titanium compound (Japanese Patent Laid-open No. Hei 5-279021). Or, using aluminum hydroxide as the material, a slurry of sodium aluminate containing red mud is mixed with quaternary ammonium and then red mud is separated (Japanese Patent Laid-open No. 2006-45053). Any product manufactured by one of the above methods may be purchased and used.

The obtained leather does not use chromium as a tanning agent and thus is chrome-free, and therefore said leather has characteristics not heretofore achievable, is flexible and has unique elasticity and softness beyond what is presented by the material hide, and also has restorability characteristics that prevent the leather from stretching more than it should. In particular, treatment using a re-tanning agent constituted by synthetic tanning agent, resin including acrylic acid, methacrylic acid, acrylic acid ester or methacrylic acid ester polymer(s) or mixture thereof, or resin including the copolymer(s) thereof, and aluminum compound, results in a leather having more favorable characteristics.

Figure 5:
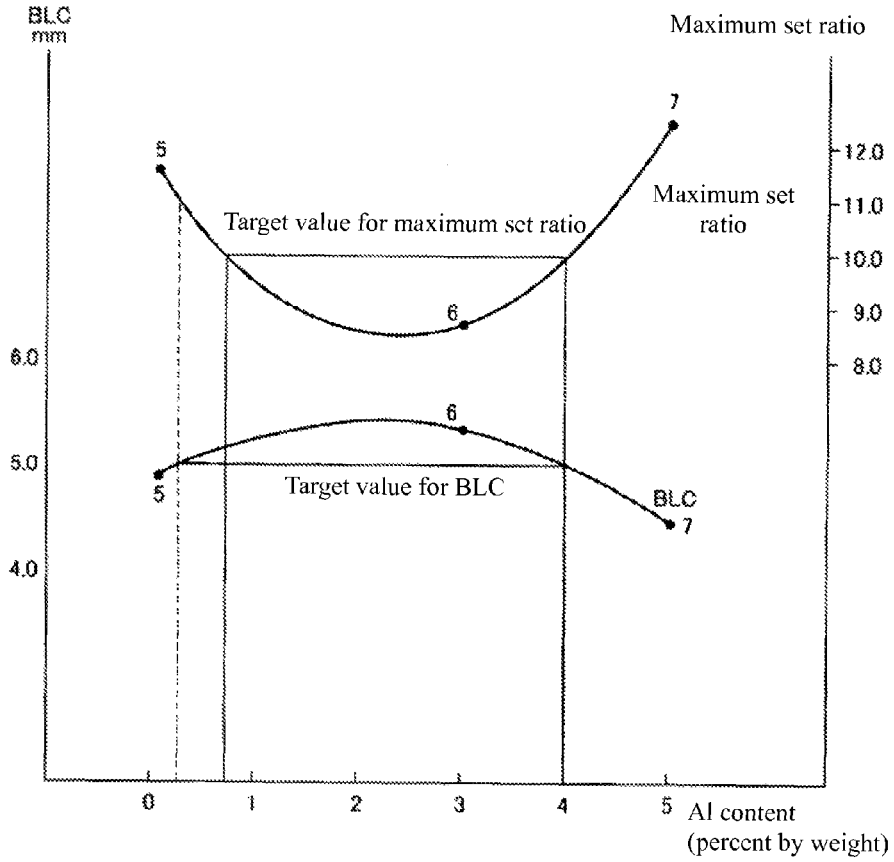
FIG. 5 Graph showing how an appropriate range of aluminum content is calculated based on Tanning Agent 4

When characteristics were measured on samples taken from a part of the leather obtained by re-tanning and subsequent post-treatment, the measured conditions included a BLC stiffness/softness of 5.0 mm or more and maximum set ratio of 10% or less. These values were obtained from the contents of examples specified below and summary of such contents (FIG. 5).

The leather obtained by the present invention is tested as explained below.

[1] Test Pieces are Taken as Follows.

Cut into half the entire leather obtained by the (1) pretreatment before tanning, (2) tanning process, (3) re-tanning process and (4) post-treatment after re-tanning, and divide the main half as deemed necessary into test pieces. Since irregular results may be obtained at edges, it is effective to cut off edges as deemed appropriate before test pieces are taken.

Test pieces may be taken in one specific direction (such as the direction of the horizontal axis) or in the other direction (such as the direction of the vertical axis). A half piece may be divided into four, six, eight, nine or 12 parts, among others. FIG. 1 is an example of dividing a half piece into nine parts.

[2] Adjustment of Test Pieces

Keep the test pieces taken from each location for at least 48 hours in a condition of 20±2° C. in temperature and 65±5% RH in relative humidity.

[3] Measurement Method of Constant-Load Set Ratio (1) Cut out test pieces of 250 mm in length×50 mm in width (FIG. 1). Take one test piece in the direction parallel with the back line (X direction) and another in the direction vertical to the back line (Y direction). The larger value of the set ratios measured on these test pieces is used as the maximum set ratio.

Figure 2:
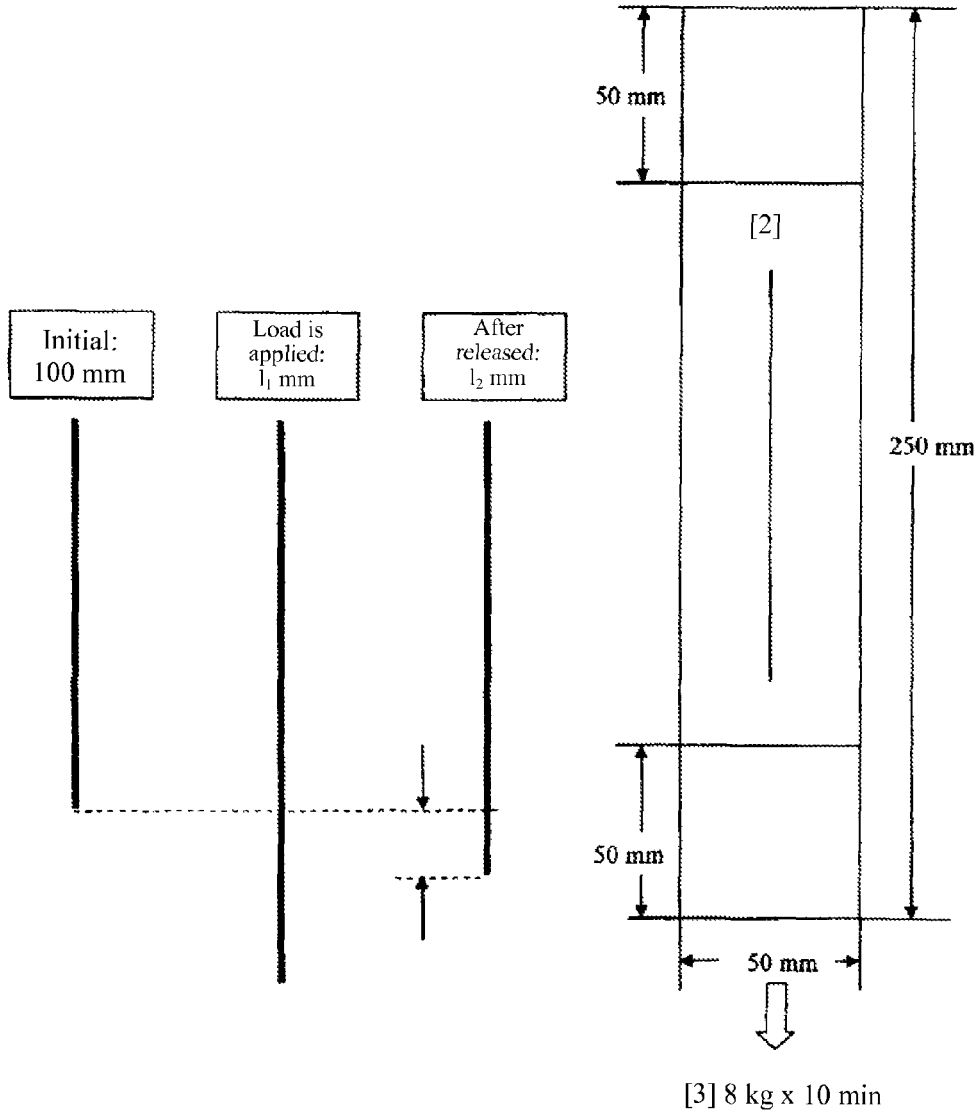
FIG. 2 Drawing illustrating a measurement sample for set ratio

(2) Designate the areas 50 mm from the top and bottom edges as leather handling areas, and draw a line extending 100 mm at the center of the remaining center area (FIG. 2).

(3) Apply a load of 8 kg to the lower part of leather for 10 minutes and then measure the length $l_1$ in mm of the line in the condition where the load is applied (this represents the constant-load elongation).

(4) Remove the load, leave the sample for 10 minutes and then measure the length of the aforementioned line again.

The result is given as $l_2$ mm.

(5) Calculate the set ratio (%) by the formula "$l_2$−100."

A smaller set ratio means that the test piece can restore its shape more easily after stretching.

As mentioned above, measurements are taken in X direction and Y direction. The longer of the constant-load set ratios measured in X direction and Y direction is called the maximum set ratio.

The target value for maximum set ratio is 10% or less. To calculate the maximum set ratio, measure three test pieces and calculate the average.

Also, the "maximum set ratio" refers to the larger of the values measured on samples taken in the two orthogonal directions corresponding to the X-axis and Y-axis of leather. The set ratio is expressed by the percentage of the elongation when the sample is stretched under a load of 8 kg, relative to the standard elongation measured after the load is removed and sample returns to its original shape, and is intended as a measure of restorability.

[4] Measurement Method of BLC Stiffness/Softness

As shown in FIG. 1, a round leather (leather of one whole cow) is divided along the center line at the back (alternate long and short dash line in FIG. 1) to obtain leather halves. BLC stiffness/softness is measured at the center of each of the nine zones defined in one leather half (the leather half on the left side of the alternate long and short dash line in FIG. 1).

Figure 3:
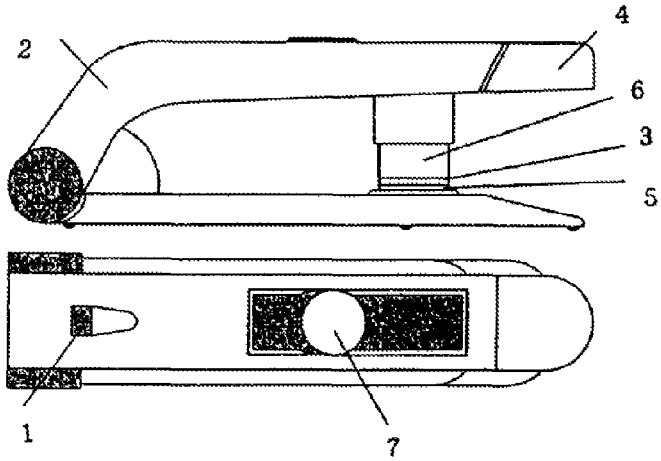
FIG. 3 Drawing illustrating a leather stiffness/softness tester

The BLC stiffness/softness test uses a ST300 leather stiffness/softness tester (FIG. 3).

Press the operation lever 4 downward while pressing the operation button 1 at the same time to operate the top arm 2. This action releases the pressure from the trapping mechanism and the top arm 2 springs upward.

Place the leather to be measured in the tester in a manner completely covering the locking means 5 at the bottom.

Press the operation lever 4 downward and pull up the top arm 2. This action causes the load plunger 6 to remain fully contracted while the top arm 2 is locked. Once the lever has been lowered and arm raised completely, a click sound is heard. The leather is now locked in the tester.

Release the operation lever 4. To do this, pull down, toward the leather, the load plunger 6 (having a 500-g weight), which is in the state controlled by the action of the air damper being contracted.

The load plunger 6 presses the leather. Read off the pressed depth on the dial 7.

When the depth has been read, press the operation button 1, pull up the top arm 2 and remove the leather.

BLC stiffness/softness is a measure of flexibility and resilience of leather when a load of 500 g is applied. The target value for BLC stiffness/softness is 5.0 mm or more.

BLC stiffness/softness is measured by the pressed depth of leather when a load of 500 g per unit area is pressed against the leather test piece, and is intended as a measure of both flexibility and resilience. The unit of BLC stiffness/softness is mm, and the indicated value provides an indicator of flexibility and restorability.

The following describes the measured conditions of leathers obtained under various conditions, as well as favorable conditions of leather determined as a result of these measured results.

Example 1

Re-tanning was performed using the tanning agent specified below. Treatment conditions other than the tanning agent conformed to those mentioned above.

Table 1 shows the composition of the re-tanning agent used in the "re-tanning" process in this example.

The data in the table indicates quantities (percent by weight) used relative to 100 percent by weight of shaved leather.

TABLE 1

| | | Re-tanning agent | | | |
|---|---|---|---|---|---|
| | | Re-tanning 1 | Re-tanning 2 | Re-tanning 3 | Re-tanning 4 |
| Plant-based tannin | | 30 | 0 | 4 | 0 |
| Synthetic tannin | Condensation product of aromatic sulfonic acid with formaldehyde | — | 22 | 4 | 12 |
| | Methylene cyclic polymer of aromatic sulfonic acid with hydroxy aromatic compound | — | 0 | 8 | 10 |
| | Glyoxal | | | 3 | 3 |
| | Synthetic tannin total | 0 | 22 | 15 | 25 |
| Resin | Polyacrylate and acrylic acid copolymer | 0 | 0 | 12 | 12 |
| | Polycondenstion product of melamine with formaldehyde | 0 | 8 | 5 | 5 |
| | Resin total | 0 | 8 | 17 | 17 |
| Metal | Aluminum compound and aluminum-containing compound | 0 | 0 | 0 | 0<br>3<br>5 |
| Re-tanning agent total | | 30 | 30 | 36 | 42<br>45<br>47 |

In the above table, the values of "aluminum compound and aluminum-containing compound" indicate the amounts of aluminum contained therein.

Re-tanning 4 with "0" aluminum (no aluminum is contained) corresponds to the results of Tests 4, 5 and 9 in Table 3.

Re-tanning 4 with aluminum contained by 3 percent by weight corresponds to the results of Test 6. Re-tanning 4 with aluminum contained by 5 percent by weight corresponds to the results of Test 7.

Re-tanning 1 uses plant-based tannin, but does not use resin, in the re-tanning agent used.

Re-tanning 2 does not use plant-based tannin, but uses synthetic tannin constituted by a mixture of aromatic sulfonic acid and condensation product of aromatic sulfonic acid with formaldehyde and also resin constituted by a polycondensation product of melamine with formaldehyde, in the re-tanning agent used.

Re-tanning 3 uses plant-based tannin, synthetic tannin constituted by a mixture of aromatic sulfonic acid and condensation product of aromatic sulfonic acid with formaldehyde or methylene cyclic polymer of aromatic sulfonic acid with aromatic hydroxy compound, and also resin constituted by a polycondensation product of acrylic resin and melamine with formaldehyde, in the re-tanning agent used.

Re-tanning 4 does not use plant-based tannin, but uses synthetic tannin constituted by a mixture of aromatic sulfonic acid and condensation product of aromatic sulfonic acid with formaldehyde or methylene cyclic polymer of aromatic sulfonic acid with aromatic hydroxy compound by the amount greater than Re-tanning 3 mentioned above, and also resin of the same type and amount constituted by a polycondensation product of acrylic resin and melamine with formaldehyde, in the re-tanning agent used.

Which of the above provides favorable results is determined by the evaluation results shown in Table 3 below.

Based on these evaluation results, the re-tanning improves in the order of Re-tanning 1 to 4. Accordingly, it is clear that use of plant-based tannin, etc., is not appropriate (Tests 1 and 2, and Tests 3 and 4), that with regard to synthetic tannin use of glyoxal is not required in many cases (Tests 3 and 4) but it is effective to use glyoxal to some extent, and that in the case of an aromatic sulfonic acid synthetic tannin it is more effective to use it in the amount greater than in Test 3 based on the results of Tests 3 and 4. As for resin, the characteristics of acrylic resin and outcomes achieved by the present invention suggest that acrylic resin gives elasticity to leather and improves its set ratio (property to easily return to the original shape after elongation) greatly. However, it is not desirable to use too much acrylic resin because it would affect the characteristics of leather excessively. In the meantime, melamine resin is expected to inherently add volume to leather, where combination of acrylic resin and melamine resin (results of Tests 1, 3 and 4, Tests 1 and 2, and Tests 2, 3 and 4) produces favorable results.

The fatliquoring agent specified below was used.

TABLE 2

| Constituent | Quantity used (percentage relative to 100 percent by weight of shaved leather) |
|---|---|
| Synthetic oil and natural oil, mixture of synthetic oil and natural constituent (weight ratio 1:1) | 17 percent by weight |

The quantity of fatliquoring agent used indicates an empirical value based on conventional re-tanning processes expressed by a percentage relative to 100 percentage by weight of leather to be treated, and is specifically calculated based on the experience that a range of 15 to 19 percent by weight is favorable.

Tanning Agents 1 to 4 above were used, with Tanning Agent 4 also mixed with aluminum separately, to perform re-tanning and the obtained leathers were measured for BLC stiffness/softness and set ratio to check the effects of each tanning agent and aluminum.

The obtained results of the respective leathers were summarized and the best results are shown.

The re-tanning treatment conditions as well as results of set ratio and BLC stiffness/softness are shown below.

TABLE 3

| | Re-tanning | | | | | | |
|---|---|---|---|---|---|---|---|
| | Re-tanning agent | | | | | | |
| Test | Synthetic tanning agent, plant-based tanning agent | Resin | Metal | Fatliquoring agent | Set ratio Average | Set ratio Maximum | BLC stiffness/softness (mm) |
| Test 1 | Re-tanning agent 1 | | | 17 | 5.67 | 7.6 | 3.67 |
| | 30 (Plant-based tannin) | 0 | 0 | | | | |
| Test 2 | Re-tanning agent 2 | | | 17 | 8.33 | 10.6 | 4.22 |
| | 30 (Synthetic tannin) | 0 | 0 | | | | |
| Test 3 No. 38 | Re-tanning agent 3 | | | 17 | 9.75 | 13.0 | 4.47 |
| | 15 (Synthetic tannin) 4 (Plant-based tannin) | 17 | 0 | | | | |
| Test 4 No. 55 | Re-tanning agent 4 | | | 17 | 9.93 | 11.1 | 4.78 |
| | 25 | 17 | 0 | | | | |
| Test 5 No. 56 | Re-tanning agent 4 | | | 17 | 8.90 | 11.5 | 4.90 |
| | 25 | 17 | 0 | | | | |
| Test 8 No. 42 | Re-tanning agent 4 | | | 17 | 8.18 | 10.7 | 4.70 |
| | 25 | 17 | 0 | | | | |
| Test 9 No. 52 | Re-tanning agent 4 | | | 17 | 8.90 | 12.0 | 4.90 |
| | 25 | 17 | 0 | | | | |
| Test 10 No. 57 | Re-tanning agent 4 | | | 17 | 10.05 | 13.9 | 4.72 |
| | 25 | 17 | 0 | | | | |
| Test 11 No. 53 | Re-tanning agent 4 | | | 17 | 9.23 | 12.4 | 4.42 |
| | 25 | 17 | 0 | | | | |
| Test 6 No. 61 | Re-tanning agent 4 | | | 17 | 6.60 | 8.5 | 5.30 |
| | 25 | 17 | 3.0 percent by weight | | | | |
| Test 7 No. 82 | Re-tanning agent 4 | | | 17 | 7.90 | 12.4 | 4.47 |
| | 25 | 17 | 5.0 percent by weight | | | | |

Shown above are the measured results of maximum set ratio and BLC stiffness/softness in Test 1 (Re-tanning Agent 1 using only plant-based tannin (not containing resin)), Test 2 (Re-tanning Agent 2 using only synthetic tannin (not containing resin)), Test 3 (plant-based tannin, synthetic tannin and resin are contained) and Test 4 (combination of synthetic tanning and resin).

The BLC stiffness/softness in Test 1 is 3.67, which is low. The maximum set ratio is 7.6, which does not present any problem, but the BLC stiffness/softness is too low. In the present invention, the results of BLC stiffness/softness and maximum set ratio must both be in a favorable range.

The BLC stiffness/softness in Test 2 is 4.22, which is low. The maximum set ratio is 10.6, which does not present any problem, but the BLC stiffness/softness is too low. In the present invention, the results of BLC stiffness/softness and maximum set ratio must both be in a favorable range.

The results of Tests 1 and 2 are based on use of plant-based tannin and synthetic tannin that have traditionally been used in re-tanning, in which sense these are considered Prior Art Examples.

Test 3 is based on a combination of plant-based tannin and synthetic tannin with a re-tanning agent containing resin. In Test 3, the BLC stiffness/softness is higher than in Tests 1 and 2, or specifically 4.47, because of the resin content, but the maximum set ratio is 13.9, which is low. In the present invention, the results of BLC stiffness/softness and maximum set ratio must both be in a favorable range.

The results of Tests 4 (Tanning Agent 4), 5 (Tanning Agent 4), 8 (Tanning Agent 4), 9 (Tanning Agent 4), 10 (Tanning Agent 4) and 11 (Tanning Agent 4) are based on a combination of synthetic tannin and resin in the tanning agent. Compared to Tests 1 to 3, these tests produce favorable results with both BLC stiffness/softness and maximum set ratio.

In Test 4, the BLC stiffness/softness is 4.78, while the maximum set ratio is 11.1.

In Test 5, the BLC stiffness/softness is 4.90, while the maximum set ratio is 11.5.

In Test 8, the BLC stiffness/softness is 4.70, while the maximum set ratio is 10.7.

In Test 9, the BLC stiffness/softness is 4.90, while the maximum set ratio is 12.0.

In Test 10, the BLC stiffness/softness is 4.72, while the maximum set ratio is 13.9.

In Test 11, the BLC stiffness/softness is 4.42, while the maximum set ratio is 12.4.

These results are shown in FIG. 4, together with the results of Tests 6 and 7 where aluminum was also used. When the results of Tests 4, 5, 8, 9, 10 and 11 are compared with the results of Test 3 based on actual measurements, it can be said that the effects of using a tanning agent constituted by synthetic tannin and resin as proposed by the present invention are represented by a BLC stiffness/softness range of 4.42 mm or more but 4.90 mm or less (B), and a range of maximum set ratio of 10.7 or more but 13.9 or less (A). (For your information, combined use of tanning agent and resin itself was not a public knowledge before the completion of the present invention, but it is presented here for the purpose of clear illustration of effects of the present invention. In this point, the values indicated by A and B above are considered the results of Examples conforming to the present invention.)

The results of treatment in a presence of aluminum with an aluminum compound added, are explained below.

Test 5 (No. 56) used aluminum by 0 percent by weight, Test 6 (No. 61) used aluminum by 3.0 percent by weight, while Test 7 (No. 82) used aluminum by 5.0 percent by weight. The maximum set ratio and BLC stiffness/softness in each case are as follows.

Specifically, in Test 6 (No. 61) the maximum set ratio is 8.5, while the BLC is 5.3. These results exceed the target value for maximum set ratio of 10.0 or less, and the target value for BLC stiffness/softness of 5.0 or more, respectively. FIG. 5 shows curves connecting the maximum set ratio and the BLC stiffness/softness results of Test 5 (No. 56) with an aluminum content of 0% (BLC stiffness/softness: 4.90, maximum set ratio: 11.5), Test 7 (No. 82 with an aluminum content of 5 percent by weight (maximum set ratio: 12.4, BLC stiffness/softness: 4.77), and Test 6 (No. 61) mentioned above. When the range of BLC stiffness/softness at the target value of 5.0 or more is obtained, together with the range of maximum set ratio of 10.0 or less, it is clear that the target value for BLC stiffness/softness is met as long as the aluminum content is in a range of 0.7 to 4.0.

Based on the above results, it can be concluded that the maximum set ratio becomes 10.0 or less and the BLC stiffness/softness achieves the target value of 5.0 or more, as long as the aluminum content is in a range of 0.7 to 4.0.

The invention claimed is:

1. A leather obtained by a process comprising (1) pretreatment before tanning, (2) a tanning process where glutaraldehyde is used as a tanning agent, (3) a process where a re-tanning agent is used which is constituted by 20 to 30 percent by weight of synthetic tannin and 13 to 25 percent by weight of resin, both relative to 100 percent by weight of shaved leather, while the aforementioned synthetic tannin is constituted by (a) 0.45 to 0.50 of condensation product of aromatic sulfonic acid with formaldehyde (b) 0.38 to 0.43 of methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, and copolymer(s) thereof and (b) 0.28 to 0.33 of polycondensation product of melamine with formaldehyde (all are weight ratios, the total of which is 1.00), wherein a fatliquoring agent constituted by (a) synthetic oil and natural oil and (b) mixture of synthetic oil and natural constituent is used in an amount of 15 to 19 percent by weight relative to 100 percent by weight of shaved leather, wherein a sample taken from a part of the leather obtained by re-tanning and subsequent post-treatment meets conditions including a BLC stiffness/softness of 4.42 mm or more but 4.90 mm or less and maximum set ratio of 10.7 or more but 12.4 or less.

2. A leather obtained by a process comprising (1) pretreatment before tanning, (2) a tanning process where glutaraldehyde is used as a tanning agent, (3) a process where a re-tanning agent is used which is constituted by 20 to 30 percent by weight of synthetic tannin, 13 to 25 percent by weight of resin and 0.7 to 4.0 percent by weight of aluminum, all relative to 100 percent by weight of shaved leather, while the aforementioned synthetic tannin is constituted by (a) 0.45 to 0.50 of condensation product of aromatic sulfonic acid with formaldehyde (b) 0.38 to 0.43 of methylene cyclic polymer of aromatic sulfonic acid with hydroxy aromatic compound and (c) 0.10 to 0.15 of glyoxal (all are weight ratios, the total of which is 1.00), while the aforementioned resin is constituted by (a) 0.67 to 0.72 of acrylic acid, and copolymer(s) thereof and (b) 0.28 to 0.33 of polycondensation product of melamine with formaldehyde (all are weight ratios, the total of which is 1.00), wherein a fatliquoring agent constituted by (a) synthetic oil and natural oil and (b) mixture of synthetic oil and natural constituent is used in an amount of 15 to 19 percent by weight relative to 100 percent by weight of shaved leather, wherein a sample taken from a part of the leather obtained by re-tanning and subsequent post-treatment meets conditions including a BLC stiffness/softness of 5.0 mm or more and maximum set ratio of 10% or less.

3. A method for producing a leather, comprising (1) performing pre-treatment before tanning, (2) performing a tanning process where glutaraldehyde is used as a tanning agent, (3) performing a process where a re-tanning agent is used which comprises 20 to 30 percent by weight of synthetic tannin and 13 to 25 percent by weight of resin, both relative to 100 percent by weight of shaved leather, of which the synthetic tannin is constituted by (a) 0.45 to 0.50 of condensation product of aromatic sulfonic acid with formaldehyde, (b) 0.38 to 0.43 of methylene cyclic polymer of aromatic sulfonic acid with hydroxy aromatic compound and (c) 0.10 to 0.15 of glyoxal (all are weight ratios, the total of which is 1.00), while the resin is constituted by (a) 0.67 to 0.72 of acrylic acid and copolymer(s) thereof and (b) 0.28 to 0.33 of polycondensation product of melamine with formaldehyde (all are weight ratios, the total of which is 1.00), wherein a fatliquoring agent constituted by (a) synthetic oil and natural oil and (b) mixture of synthetic oil and natural constituent is used in an amount of 15 to 19 percent by weight relative to 100 percent by weight of shaved leather, and (4) performing post-treatment after re-tanning, wherein a sample taken from a part of the leather obtained by the re-tanning and subsequent post-treatment meets conditions including a BLC stiffness/softness of 4.42 mm or more but 4.90 mm or less and maximum set ratio of 10.7 or more but 12.4 or less.

4. A method for producing a leather according to claim 3, wherein the re-tanning agent further comprises aluminum compound.

* * * * *